US006260292B1

(12) United States Patent
Swedick et al.

(10) Patent No.: US 6,260,292 B1
(45) Date of Patent: Jul. 17, 2001

(54) SPIKE-LOC, A REPLACEABLE SPIKE SYSTEM AND THE SOLE

(76) Inventors: William Louis Swedick; Mickey Lynn Swedick, both of 1449E 1000 North Rd, Taylorville, IL (US) 62568

( * ) Notice: Subject to any disclaimer, the term of this patent is extended or adjusted under 35 U.S.C. 154(b) by 0 days.

(21) Appl. No.: 09/533,017

(22) Filed: Mar. 22, 2000

Related U.S. Application Data

(60) Provisional application No. 06/127,428, filed on Apr. 1, 1999.

(51) Int. Cl.[7] ..... A43B 5/00
(52) U.S. Cl. ..... 36/134; 36/67 D
(58) Field of Search ..... 36/42, 67 D, 134, 36/36 R, 36 B, 36 C, 15

(56) References Cited

U.S. PATENT DOCUMENTS 2,006,401 * 7/1935 Maccarone ..... 36/42
2,607,135 * 8/1952 Langer ..... 36/67 D
2,707,341 * 5/1955 Romano ..... 36/42
3,566,489 * 3/1971 Morley ..... 36/67 D
4,035,934 * 7/1977 Hrivnak ..... 36/67 D
4,318,232 * 3/1982 Ching ..... 36/67 D
4,416,072 * 11/1983 Sarkissian ..... 36/42
5,875,572 * 3/1999 Redburn ..... 36/134
5,887,360 * 3/1999 Bucalo et al. ..... 36/42

* cited by examiner

*Primary Examiner*—M D Patterson

(57) ABSTRACT

A replaceable spike system consisting of the sole and the heel for convenient insertion and replacement of a spike thereof. The spike assembly includes a "ball and spring" mechanism for the purpose of said spike assembly from falling out of the receiver member. The receiver member can be a mounted part of the sole of the sole or heel of the shoe consists of 2 spherical radii on the internal wall wherein the ball seats in a extended position. The release tool is manually inserted for disengaging the spike assembly from the receiver member.

6 Claims, 2 Drawing Sheets

SPIKE-LOC, A REPLACEABLE SPIKE SYSTEM AND THE SOLE

CROSS-REFERENCE TO RELATED APPLICATIONS

This application claims the benefit of Provisional Application Ser. No. 06/127,428, filed on Apr. 1, 1999.

FIELD OF THE INVENTION

Our invention relates to sport shoes, spikes or cleats extending downwardly from the sole. A replaceable spike system consisting of the sole of the shoe, a receiver member, and the spike assembly. The purpose of this invention is to provide the convenience of quick removal and replacement, while secure fixation of the spike or cleat, by using a "ball and spring" mechanism housed within the spike. A release tool or rounded rod, such as a nail, can be utilized to disengage the spike from the sole of the shoe, thereby unlocking is achieved. This invention can be used for any and all athletic footwear such as, climbing, track and field, football, baseball, soccer, and golf alike. In addition, this invention can benefit anyone in sports from adolescents to older age groups. This spike system has the capability of interchangeable spikes or cleats, from one design of a gripping element to another design depending upon the field or turf its used on.

BACKGROUND OF THE INVENTION

In the past, golfers wore metal or steel spikes since early 1900's, nevertheless, they became banned at many courses, in an effort to improve and maintain the greens. Recently, soft spikes were made of plastic material and they were made as an alternative to many problems associated with metal spikes or cleats. There are many different types of soft spikes and configurations used to affix or retain the spike to the sole of the shoe or the receiver member and have numerous drawbacks.

One example, as described in U.S. Pat. No. 5,638,615, Korsen, SHOE SPIKE APPARATUS, they claim a plurality of spring fingers affixed to the plate retains the spike member firmly and without lateral movement while providing for quick release and removal. This invention does provide for quick release and removal but, the spike can become unintentionally disengaged with wear.

Another example, as described in U.S. Pat. No. 5,768,809, Savoie, QUICK-RELEASE SPIKE FOR FOOTWEAR, they claim the spike encounters a quarter of a turn, respectively of 60 degrees, causing the tip of one of the extensions to slide over the edge of the spike opening, providing a locking mechanism. The disadvantage to this invention is a quarter of a turn in the opposite direction can cause the spike to disengage or dislodge and fall out.

Another example, as described in U.S. Pat. No. 4,633,600, Dassler et al, OUTER SOLE FOR AN ATHLETIC SHOE HAVING CLEATS WITH EXCHANGEABLE SNAP-ON GRIPPING ELEMENTS, they claim a snap-lock arrangement which is composed of an annular rib which engages annular groove thereby fastening is achieved. The disadvantage to this invention is that the annular rib from constant movement can displace the spike, and it would be complicated to manufacture. Finally, another example is U.S. Pat. No. 3,267,593, REPLACEABLE SPIKE FOR SHOES, Turner, they claim the spike is inserted into the receiver chamber until the wings clear. The spike is turned then the retaining ring is slid onto the groove. However, support is accomplished by locking of the wings.

All these examples, show many different ways for retaining spikes to a receiver member or the sole of the shoe such as, spring fingers, sliding over the shoulders, an annular rib, or locking of the wings, however, it would appear to be unintentionally complex for their use, can disengage easily by wear or quick movement of the shoe, and lack firmness and rigidity.

BRIEF SUMMARY OF THE INVENTION

It is an important objective with this invention to provide a structure not consisting of threads, spring fingers, clamps or a clamp-ring, washers, annular rings and the like. Our intentions with this invention is to hold the spike in place by using the "ball and spring" mechanism for easy insertion and removal without damage to the shoe sole. Moreover, to provide a construction of components made for recycling purposes, and provide a sturdy material, non-corrosive, durable, and provide a firm support while wearing. Another objective with this invention is to provide a structure for a shoe sole and spike that would be easy to assemble and manufacture and inexpensive to make and provide a better means of traction, gripping, and non-slipping to prevent accidents. Additional objectives and advantages over prior art will become more apparent, and understanding from the following description, taken in conjunction with the accompanying drawings forming a part of the specifications.

DETAILED DESCRIPTION OF THE INVENTION

Figure 1:
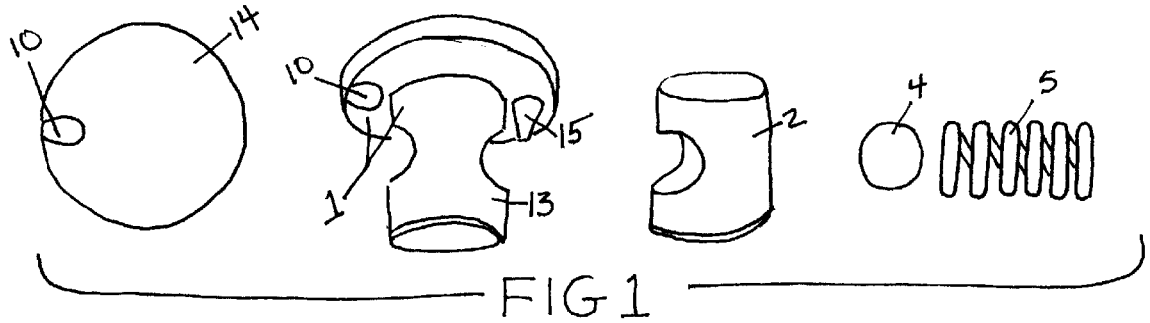
FIG. 1. Shows the top view of the spike 1, as a flat or plain surface 14, a front view of the body of the spike 13, a front view of the brass sleeve 2, and plain view of ball 4, and spring 5.
Figure 2:
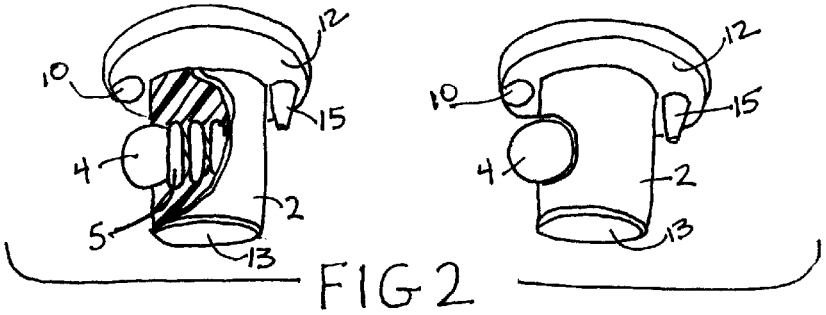
FIG. 2. Shows the front view of the body of the spike 13, wherein houses the ball 4, and spring 5, and another front view of the brass tubing 2, encased around the body of the spike 13, containing the ball 4, and spring 5.
Figure 3:
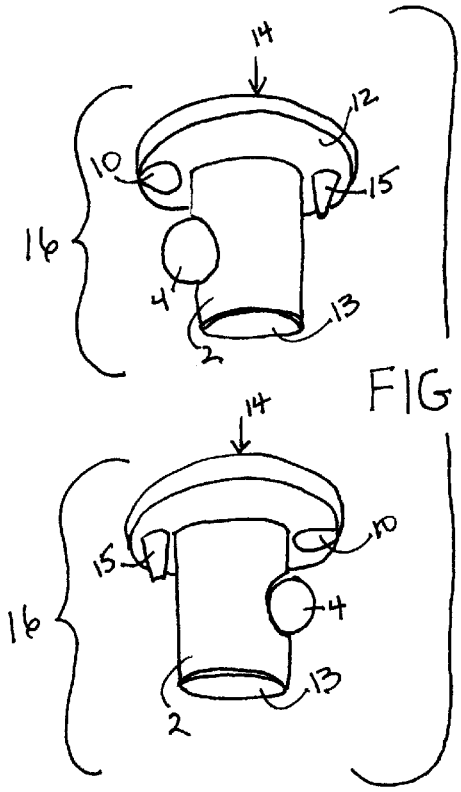
FIG. 3. An assembled front view of the spike assembly 16, with a protrusion 15, extending downward from the flange 12, and the release hole 10. The second view is a rotated (180 Degree) view of the spike assembly with a protrusion 15, extending downward from flange 12, and the release hole 10.
Figure 4:
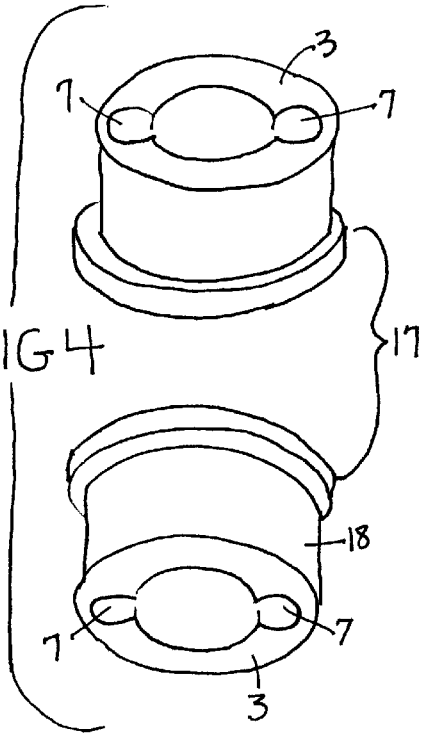
FIG. 4. A front view of the receiving member 18, representing two angled release slots 7. A bottom view of the receiving member representing two angled release slots 7.
Figure 6:
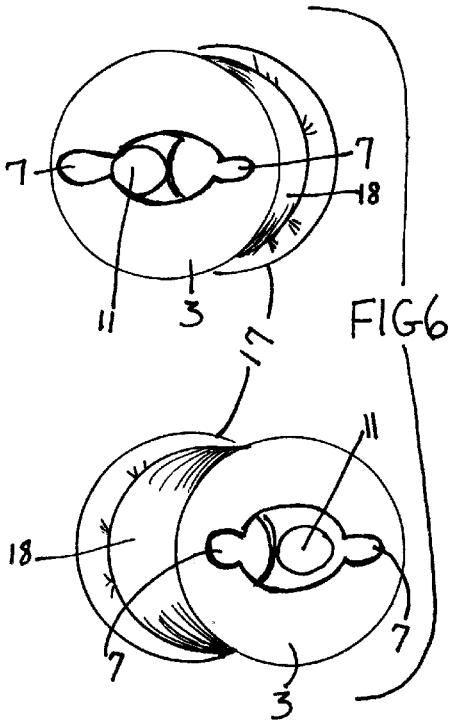
FIG. 6. A top (left) interior view of the receiving member showing the spherical radius 11, and a top (right) interior view of the receiving member showing the other spherical radius 11, located along the interior side of the receiving member, these radii are 180 degrees apart.
Figure 7:
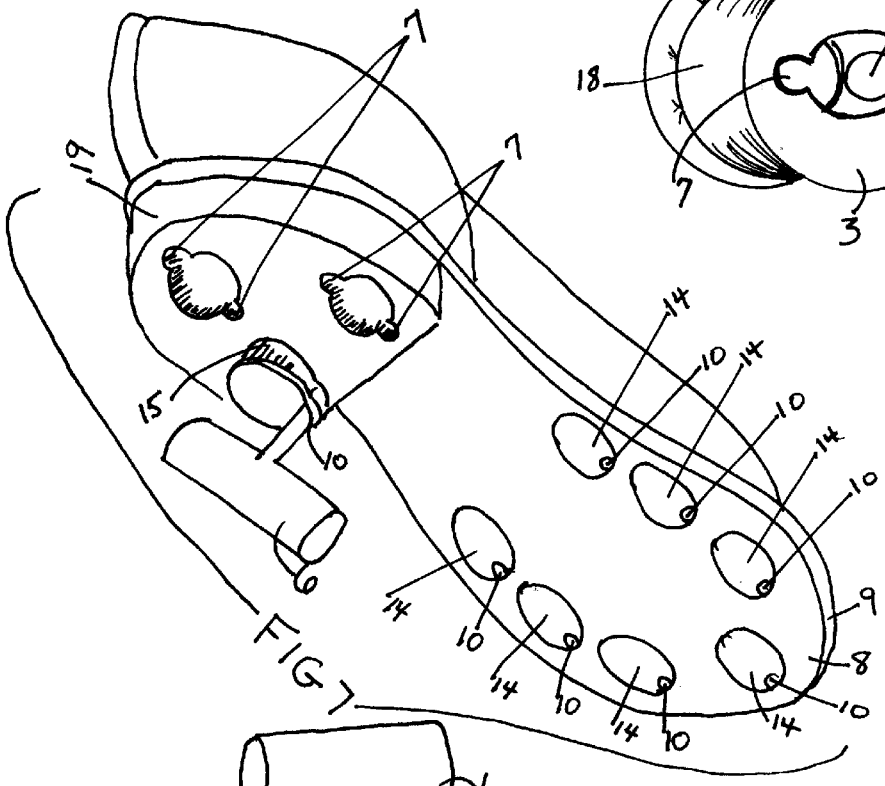
FIG. 7. An exploded view of a shoe with outer sole 8, attatched to the inner sole 9, consisting of a plurality of spikes through out the sole and the heel each consisting of two release slots 7, and another view of a release tool 6 affixed within the release hole 10 and the spike 1, disengaged from the heel representing the spring 5, in a retracted position. As an alternative the top 14, of the spikes can have a membrane of like material, of thin construction, to cover the 10 release holes to prevent dirt or any other particles to prevent clogging until necessary to change the spikes.
Figure 8:
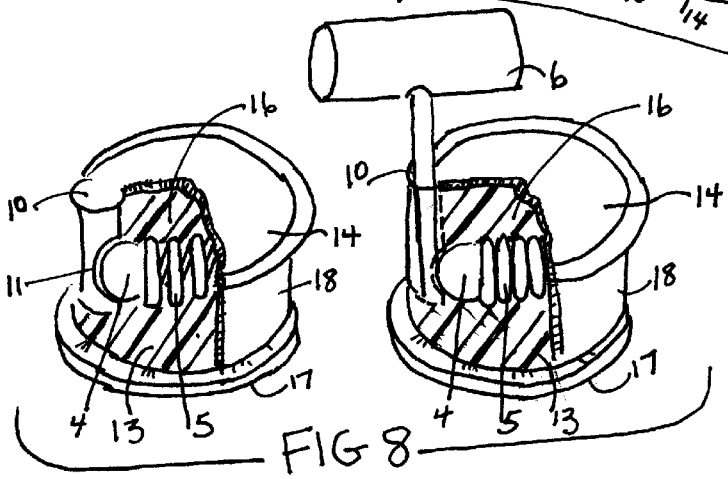
FIG. 8. A side view of the spike assembly 16, within the receiving member 18, showing the ball and spring in an extended position against the spherical radius to hold the spike in a film or locked position. Meanwhile, another side view of the spike assembly 16, within the receiving member 18, with the release tool exerting force on the ball and compressing spring into a disengaged or unlocked position. The pressure of the spring on the ball against the release tool causes the spike assembly 16, to "slide-up" the tool; partially exiting the receiver member 18.

Referring to the drawings, the present invention is shown in FIGS. 1 through 8 and are constructed according to the present invention includes the spike assembly 16, FIG. 3 and FIG. 8 the receiving member 18, shown in FIGS. 4, 5, 6, and 8. The heel 19, FIG. 7 and outer sole 8, FIG. 5 and FIG. 7 of the shoe can have various changes in dimensions, form or detail of construction, but these do not change the scope and spirit of the invention "Spike-Loc."

It may be seen from the drawings, FIG. 3 the spike assembly 16 including a release hole 10 (an angled hole), in the top of the spike for insertion of the release tool 6, FIGS. 7 and 8, such as to guide the release tool inside the receiving member 18. This function will be hereinafter described. Also, the spike assembly 16, FIG. 3, contains a flange 12 wherein the body of the spike 13 protrudes containing the ball 4 and the spring 5, FIG. 2, shows body of the spike 13, encased inside a brass tubing sleeve 2. The ball protrudes partially through one wall, of the brass sleeve 2 of the spike assembly 16. Furthermore, a protrusion 15 positioned 180 degrees from the release hole 10 extending from the flange 12. Protrusion 15 has the function is to keep the spike from any rotation Protrusion 15 extends into either angled slot 7, FIG. 4, FIG. 5, FIG. 6, and FIG. 7. The body of the spike 13, FIG. 3 is preferably constructed of a durable material, such as pliable polyurthene.

Figure 5:
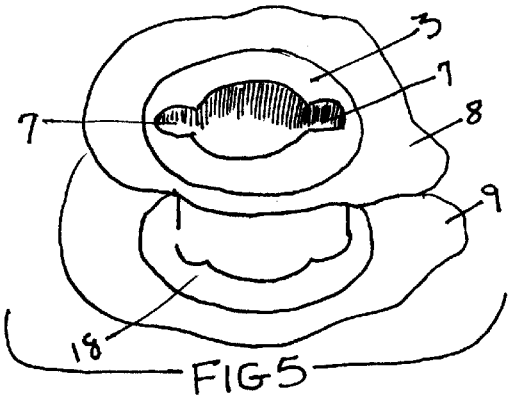
FIG. 5. A front view of the receiving member in an upright position seated against of the inner sole 9, extending upward through the outer sole 8, also, showing the location of two spherical radii 11, formed internally along the wall of the receiving member. As an alternative, using correct dimensions, the receiver member can become a molded part of the shoe sole and heel.

Another embodiment of the present invention is the receiving member 18, shown in FIGS. 4, 5, 6, and FIG. 8 preferably constructed of a hard durable material, such as rigid plastic polyurethene, FIG. 5, illustrates two elongated openings namely angled release slots 7 their function is to guide release tool 6 or protrusion 15 when assembled. The release holes 10 can be aligned with either angled release slots 7 for connecting the spike assembly to the receiving member. Also, within the interior wall of the receiving member as illustrated in FIG. 5, FIG. 6 and FIG. 8 are the spherical radii 11 located horizontally in line with the ball 4 their purpose is to retain the spike assembly by force of the spring 5, (FIG. 1, FIG. 2 and FIG. 8) when the ball 4 is located in either one of the spherical radii 11. It will remain in this extended position until system is deactivated by the release tool 6, FIGS. 7 and 8, or any small diameter rod, such as a nail. As illustrated in FIG. 8 the release tool 6 is inserted into the angled release hole 10 pressure is applied, putting force on the release tool 6 the ball 4 will move inward compressing the spring 5 thereby unlocking is achieved. Hence, specific characteristics, dimensions, and other physical characteristics relating to the embodiments disclosed herein are not to be considered as limiting, unless the claims expressly state otherwise. This embodiment receiving member 18, FIG. 4, dimensionally may be formed as part of the sole or heel or as a seperate member, housed within a hollowed-out portion of the heel or sole. The main function of receiving member 18 is to accept and hold the spike assembly 16. Furthermore, as illustrated in FIG. 7, referring to the release holes 10 as an alternative, the top of the spikes, when molded or formed, can have a thin membrane of the same or like material, to cover the release tool holes. This membrane will be pierced by release tool 6 only as necessary to remove a spike assembly 16. No tool is required to install any new spike or cleat. However, upon discretion of the manufactuer, the top surface of the spikes14 FIG. 1, FIG. 3 and FIG. 8, can be any one of several ornamental flat, or functional designs as may be required.

We claim:

1. A shoe containing a replaceable spike system comprising: an outsole with a plurality of receiving members each receiving member having an opening and a plurality of release slots adjacent the opening, a spike assembly comprising a body and a ball and spring member provided within the body, the ball protruding outwardly from a side of the body, the receiving member having a depression located within the opening on a side wall of the receiver member at a location corresponding to the location of the ball on the spike assembly body for receiving the ball, the depression being aligned with one of the release slots such that a tool may be inserted into the slot to release the spike assembly from the receiving member.

2. A shoe containing a replaceable spike system, according to claim 1, wherein each spike has a head portion. a flange portion, and a bottom.

3. A shoe containing a replaceable spike system, according to claim 2, wherein the "ball and spring" member is housed within the bottom of the spike and held in place by a brass tubing sleeve.

4. A shoe containing a replaceable spike system, according to claim 2, where there is a protrusion extending downward from the flange, located 180 degrees opposite of a release hole, the protrusion providing means of guiding the spike assembly inside said receiver member.

5. A shoe containing a replaceable spike system according to claim 2, a release hole located in the head and flange portions of spike for insertion of a release tool for manual activation by user to release the spike assembly from the receiver member.

6. A replaceable shoe spike system, according to claim 1, wherein the ball protrudes horizontally outward from said spike assembly.

* * * * *